US005655203A

United States Patent [19]

Thayer et al.

[11] Patent Number: 5,655,203

[45] Date of Patent: Aug. 5, 1997

[54] NON-ROTATING RETRACTED CLEANING BRUSH

[75] Inventors: Bruce E. Thayer; Dennis G. Gerbasi, both of Webster; Clark V. Lange, Ontario; Ronald E. Auty, Rochester, all of N.Y.

[73] Assignee: Xerox Corporation, Stamford, Conn.

[21] Appl. No.: 480,634

[22] Filed: Jun. 7, 1995

[51] Int. Cl.[6] ..... G03G 21/00

[52] U.S. Cl. ..... 399/345

[58] Field of Search ..... 355/296, 297, 355/299, 301, 302; 399/343, 345, 353

[56] References Cited

U.S. PATENT DOCUMENTS 4,664,505 5/1987 Itaya et al. .
5,083,169 1/1992 Usui et al. .
5,177,553 1/1993 Ohike et al. .
5,260,754 11/1993 Yano et al. .
5,442,422 8/1995 Owens, Jr. et al. .
5,450,186 9/1995 Lundy .
5,493,383 2/1996 Pozniakas et al. .

*Primary Examiner*—Sandra L. Brase
*Attorney, Agent, or Firm*—T. L. Fair

[57] ABSTRACT

An apparatus and method for stopping rotation and retracting a cleaning brush away from contact regions to avoid the occurrence of flat spots or voids in the cleaning brush and prevent toner emissions from the cleaning brush as it is retracted. The cleaning brush is rotated about a pivot point to move the cleaning brush away from contact with the photoreceptor and the detoning roll. The pivot point is positioned so that the variation in interference to the detoning roll is minimized for variations in the interference and location of the brush against the photoreceptor. Each cleaning brush has a housing that moves in conjunction with the movement of the cleaning brush in order to avoid contact between the housing and the cleaning brush. This cleaning apparatus also enables development of multi-layer color images.

25 Claims, 6 Drawing Sheets

NON-ROTATING RETRACTED CLEANING BRUSH

BACKGROUND OF THE INVENTION

This invention relates generally to a cleaning apparatus, and more particularly concerns preventing toner emissions and flat spots on a retracting cleaning brush.

In an electrophotographic application such as xerography, a charge retentive surface (i.e., photoconductor, photoreceptor or imaging surface) is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charge surface may be imagewise discharged in a variety of ways. Ion projection devices where a charge is imagewise deposited on a charge retentive substrate operates similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a-brush with soft electrically biased conductive fiber bristles or with insulative soft bristles which have suitable triboelectric characteristics. The brush fibers retain particles removed from the surface. A detoning roll is one common method of removing these particles from the cleaning brush fibers.

When an electrostatic brush, detoning roll cleaner is in standby and the brush is stationary, the brush after time will take a set in the nip region between the brush and any contacting surface. The brush fibers will deform in such a way as to cause a flat spot in the brush. This flat spot impairs cleaning and impacts photoreceptor motion quality.

The following disclosures may be relevant to various aspects of the present invention and may be briefly summarized as follows:

U.S. Pat. No. 5,260,754 to Yano et al. discloses a cleaning device incorporated in an image forming apparatus for removing a toner remaining on a photoconductive drum by a fur brush and collecting the removed toner by a collecting roller. The cleaning device selectively moves the fur brush into and out of contact with both of the photoconductive drum and collecting roller.

U.S. Pat. No. 5,177,553 to Ohike et al. discloses a method of controlling rotation of a brush in a cleaning device of an image forming system. In the method, the brush is raced together with the photoreceptor which is in contact with the brush for a predetermined time in a warming-up period before the image forming operation starts, in an image-forming rest period, or when a new cartridge constituted by the photoreceptor and the cleaning device is set into the image forming system, so that the fibers of the brush which have been transformed during the rest of rotation are recovered into their original shapes.

SUMMARY OF INVENTION

Briefly stated, and in accordance with one aspect of the present invention, there is provided an apparatus having a cleaning subsystem for removing particles from a surface in a printing machine, having an operational mode and a non-operational mode, comprising: a deformable member for removing the particles from the surface; member in contact with the deformable member; and means for moving the deformable member into and out of contact with the member to prevent the formation of a planar region on the deformable member.

Pursuant to another aspect of the present invention, there is provided a method for removing particles from a surface, with a rotatable deformable member, in an electrostatographic machine having a cleaning subsystem, in contact with a member, comprising: stopping operation of the cleaning subsystem; stopping rotation of the deformable member; and retracting the rotatable deformable member about a pivot, out of contact with the member to prevent contact therebetween in a common area for a substantial period of time to prevent forming a planar region on the rotatable deformable member.

Pursuant to another aspect of the present invention, there is provided a method for removing particles from a surface, with deformable members including a first deformable member and a second deformable member located downstream from the first deformable member, in an electrostatographic machine having a cleaning subsystem, in contact with a member, comprising: stopping operation of the cleaning subsystem; retracting the first deformable member from the surface; and stopping rotation of the second deformable member and the first deformable member during retracting of the second deformable member.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1:
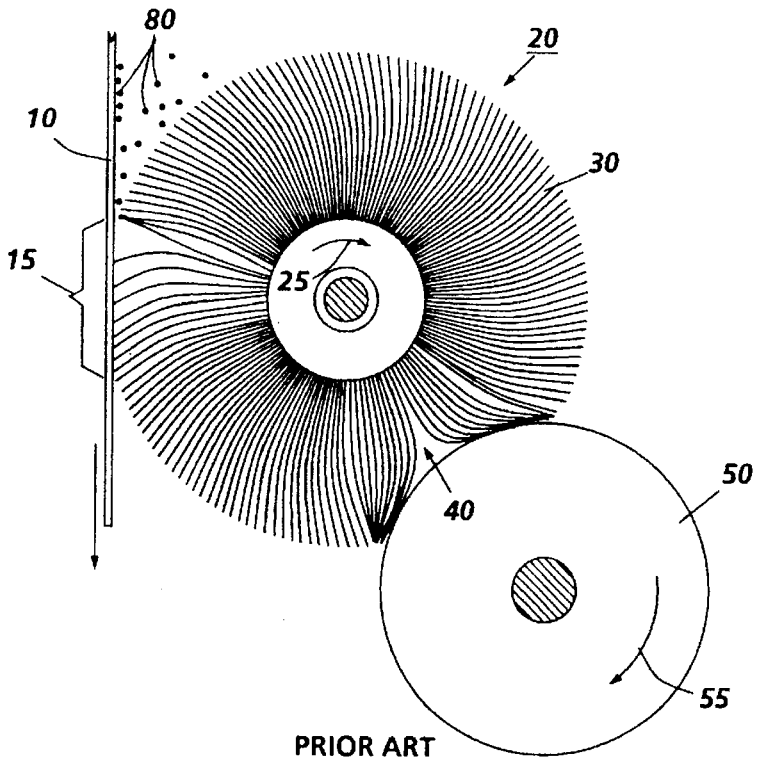
PRIOR ART FIG. 1
FIG. 1 is an elevational view of a cleaner brush in contact with a detoning roll and the photoreceptor causing a flat spot.
Figure 4:
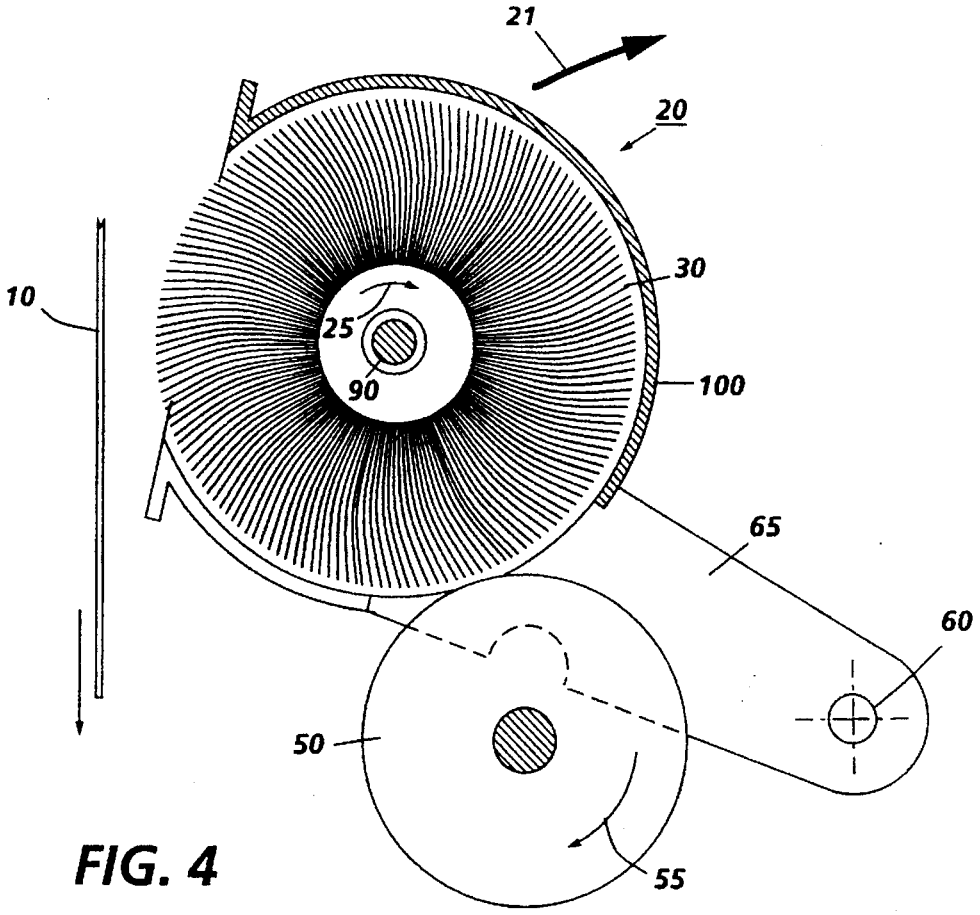
FIG. 4 is an elevational view of the present invention of a cleaner disengaged from photoreceptor and detoning roll.

Reference is now made to FIG. 1, which shows a prior art elevational view of a cleaner brush in contact with a detoning roll causing a flat spot. The brush 20 rotates in the direction indicated by arrow 25, in the against mode relative to the direction of movement of the photoreceptor 10. The detoning roll 50 rotates in a direction indicated by arrow 55. The detoning roll 50 is contacted by the brush fibers 30 in a flicking action to remove toner particles from the brush fibers 30. Presently, when an electrostatic brush detoning roll cleaner is in the standby mode and the brush is stationary, the brush 20 after time will take a set in the nip region between the brush 20 and any contacting surface (e.g. photoreceptor 10, detoning roll 50). The brush fibers 30 will deform in such a way as to cause a flat spot 40 in the brush 20. This flat spot 40 impairs cleaning and impacts photoreceptor motion quality. The present invention retracts the brush 20 from the contact regions of the photoreceptor 10 and the detoning roll 50, when the cleaner is in the standby mode (see FIG. 4). The lack of contact between the brush 20 and the contact regions, during standby, prevents flat spots 40 from occurring in the brush 20. Also, this lack of contact allows any set of the fibers incurred during the cleaning operation to at least, partially recover during standby.

Electrostatic brush detoning roll cleaners operate by removing the residual toner 80 from the photoreceptor 10 both with mechanical and electrostatic forces. The fibers 30 on the brush 20 touch the residual toner on the photoreceptor 10 in the photoreceptor/brush 15 nip region. The toner 80 is then transported by the brush to the detoning roll 50 and the brush 20 touches the detoning nip region. When the cleaner is in standby or the machine is off, the brush fibers 30 will deform due to the contact areas around the brush 20. A flat spot 40 will occur if the brush is stationary for a long enough period of time. When the brush is rotated again, the flat spot will slowly disappear. If the flat spot 40 was large enough, both the cleaning function and the motion quality of the photoreceptor 10 can be damaged. The recovery time of deflected brush fibers to a straight condition is a function Of temperature, relative humidity, fiber material and stress history. Therefore, depending on conditions, the fibers may fully recover or some permanent deflection may remain.

Figure 2:
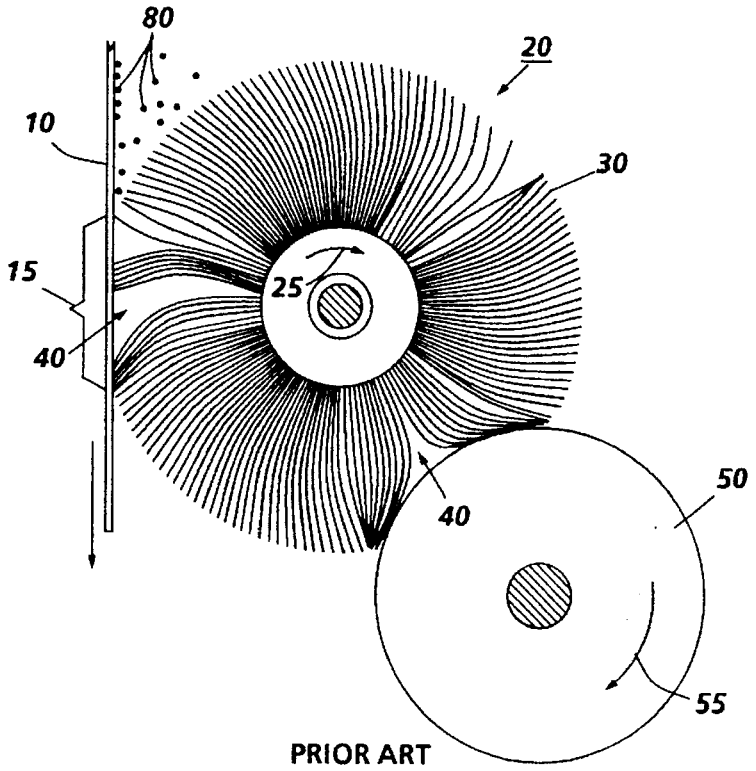
PRIOR ART FIG. 2
FIG. 2 is an elevational view of a flat spot created by the detoning roll rotating about the brush axis.

Reference is now made to FIG. 2, which is a prior art elevational view of a flat spot created by the detoning roll rotating about the brush axis. Brush cleaning is dependent upon the number of brush fibers 30 touching the photoreceptor 10 during cleaning. When there is a flat spot 40 in the brush 20 used for cleaning, the number of brush fibers 30 touching the photoreceptor 10 is reduced. Thus, the brush flat spot 40 region will not effectively clean toner from the photoreceptor 10 due to a decrease in brush fibers 30 contacting the photoreceptor 10. The flat spot 40 causes a drag transient on the photoreceptor 10 which adversely affects photoreceptor motion quality.

With continuing reference to FIG. 2, the compression force from the brush 20 is also dependent on the number of brush fibers 30 touching the photoreceptor 10 and their interference to the photoreceptor 10. When there is a flat spot 40 in the brush 20, the number of brush fibers 30 touching the photoreceptor 10 is reduced and there is locally less interference between the brush fibers 30 and the photoreceptor 10. The brush flat spot 40 region will cause a decrease in the compression force on the photoreceptor 10 from the brush 20. A decrease in compression or normal force on the photoreceptor 10 will cause a decrease in drag on the photoreceptor 10. This decrease or change in the drag can cause motion quality errors depending on the magnitude of the drag change and how fast the drag changes which is dependent on brush speed.

In the present invention, the brush 20 is removed from regions (e.g. photoreceptor, detoning roll) where the brush flat spot 40 will occur. (see FIG. 4.) Without contact with the brush fibers 30, a brush flat spot will not occur. A flat spot can occur at the brush to photoreceptor contact region 15, the brush to detoning roll region, brush to flicker bar region, or possibly brush to housing region. Removing or retracting the brush from contact regions would be expensive for conventional brush cleaners. A conventional cleaner has relatively few moving parts. The brush, auger, and detoning rolls each rotate but do not move relative to the contact regions where the brush flat spot can occur. Additional solenoids and motors would have to be added to move the brush from the contact regions.

A multi-pass color cleaner has cleaner components that move relative to the contact regions. In a multi-pass operation, the cleaner must be removed from the photoreceptor until after the image is transferred. If the cleaner is not removed, the cleaner will remove the untransferred toner image. In this case of a brush cleaner, the brush is removed from the photoreceptor. By using the same mechanism that removes the brush from the photoreceptor 10, the brush flat spot 40 can be removed very inexpensively. When the brush is in stand by or the machine is off, the brush should be off the photoreceptor 10. If the brush rotates around a carefully chosen pivot point, the flat spots due to housings, flicker bars, and detoning rolls can be avoided (see FIG. 8) by positioning the pivot so that there are no contact regions when the brush is retracted from the photoreceptor 10. The brush would rotate about the pivot point to move away from the photoreceptor and away from the detoning roll. The pivot point is chosen so that the variation in interference to the detoning roll is minimized for variations in the interference and location of the brush against the photoreceptor. This is accomplished by the brush coming into contact with the detoning roll on an arc tangent to the detoning roll surface.

In addition to preventing flat spots, the present invention decreases the rate at which the brush takes a set. By allowing the entire brush to be retracted from contacting surfaces when not in use for cleaning, the brush fibers which take a set during normal use can recover from that set. Set recovery extends the useful life of the brush. This is especially important for short pile height, small diameter brushes. The shorter pile heights result in stiffer brush fibers which take a set sooner because of higher strains and give larger compression forces on the photoreceptor which yields higher drag forces. The fiber strikes of smaller brushes are also more effected by tolerances and the presence of flat spots. All these factors are reasons for the present invention to retract the brush from contact from surfaces. A single pass brush cleaner which normally would not have a retraction mechanism is also retracted, in the present invention, to avoid brush flat spots.

Figure 3:
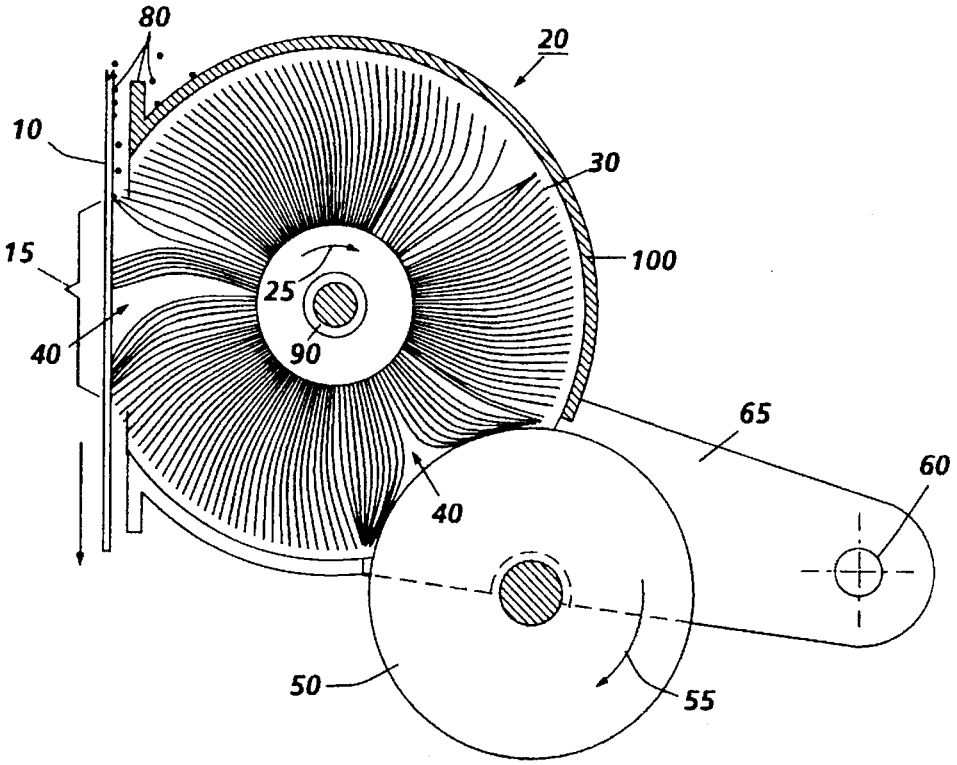
FIG. 3 is an elevational view of a brush and housing mounted to a retraction pivot arm capable of rotating about a pivot with the brush in contact with the photoreceptor and the detoning roll.

Reference is now made to FIG. 3, which shows an elevational view of a brush and housing mounted to a retraction pivot arm. The pivot arm 65 is capable of rotating about a retraction pivot 60 with the brush in contact with the photoreceptor and the detoning roll 50. The brush housing 100 surrounding the retractable cleaning brush maintains a close clearance to the brush to minimize toner emissions. In order to allow retraction of the brush, the cleaner housing moves with the brush as it retracts. This is accomplished by mounting the cleaner housing to endplates which contain brush bearings 90. The endplates are then mounted to the pivot arms which rotate to retract the brush and housing. The pivot arm allows a simple drive to the brush 20 through a drive shaft located at the pivot 60.

With use, the brush diameter decreases due to set of the brush fibers caused by the interferences in the photoreceptor and detoning roll nips. This is a time and environment dependent phenomenon which is reversible over relaxation time periods of no fiber deflection for at least as long as the time duration during which the fiber was deflected. Since the relaxation time periods are not sufficient to offset the brush diameter reduction, in time the brush will have to be replaced because the number of fibers striking the photoreceptor is insufficient for good cleaning. To extend the useful life of a brush, the interferences to the photoreceptor and to the detoning roll (relative to the original brush diameter) can be increased as the brush diameter decreases. The interferences are to be increased such that the photoreceptor interference always remains less than the detoning roll interference. This is accomplished by proper positioning of the detoning roll and retraction pivot. Increasing the interference of the brush can be done at predetermined copy count intervals, by the tech rep as required for good cleaning or through an automatic sensing system (e.g., brush size, brush compression force, brush electrical current, etc.).

Figure 5A:
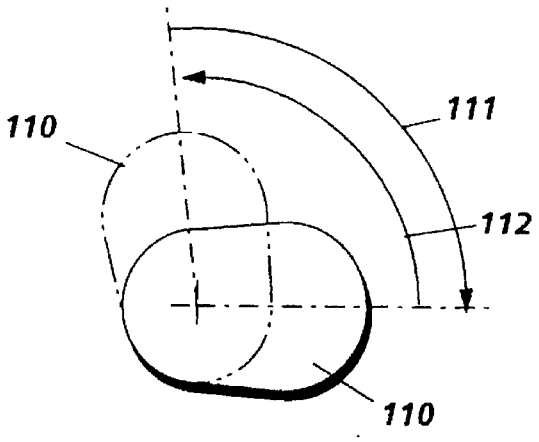
FIG. 5A is a schematic of a cam reversal of the present invention.
Figure 5B:
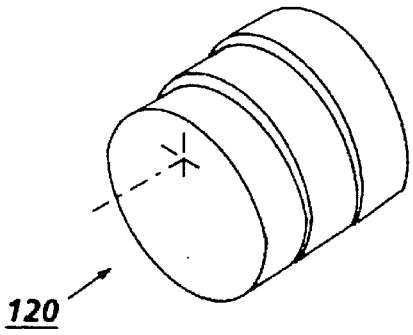
FIG. 5B is a schematic of an alternate embodiment in which the cam rotates in one direction only.
Figure 5C:
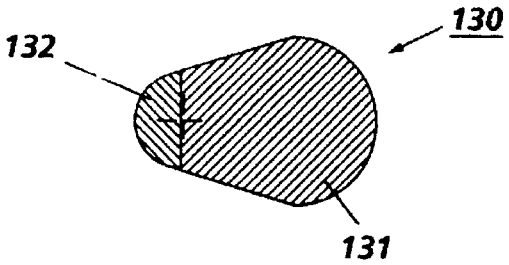
FIG. 5C is a schematic of an alternate embodiment in which the cam material dimension changes to increase interference.

Reference is now made to FIGS. 5A, 5B, and 5C. When using a brush retraction system with an adjustable interference feature it is desirable to avoid any increase in brush interference before required to compensate for a brush-set-induced reduction in the brush diameter. With a cam driven retraction system the cam must have the capability of increasing the interference to the highest level desired at the end of brush life. The simplest operation of such a cam is to rotate the cam for a full revolution in each retraction and engagement cycle, as shown in FIG. 5A. This cycles the brush through the maximum interferences on each retraction cycle. This results in an acceleration of the brush set, reducing the brush life and defeating the purpose of the adjustable interference feature. To avoid increasing interference on every retraction cycle, the cam can be reversed on retraction. A reversible motor drive can be used to cause the cam 110 to rotate in the manner shown by arrows 111 and 112.

Another method would use a multiple position cam 120 that creates different amounts of interference on different positions of the cam 120, as shown in FIG. 5B as an isometric view. The position of the cam 120 to be used can be changed automatically or by a technical representative.

Reference is now made to FIG. 5C which shows a third method to change interference involving the use of a compressible material for the portion of the cam 130 controlling interference. The compressible material portion 131 of the cam is chosen to match the set properties of the brush fibers 30 such that as the brush fibers 30 take a set, the cam also takes a set and allows the brush interference to increase at the same rate as the brush diameter decreases. The compressible material portion 131 of the cam includes urethane, nylon or other plastics, The remaining portion of the cam material 132 includes metal or plastics such as delrin, polycarbonate, nylon, acetal or others. In all of these methods the cleaner brush is not subjected to increasing interferences until the brush diameter has decreased.

Figure 6:
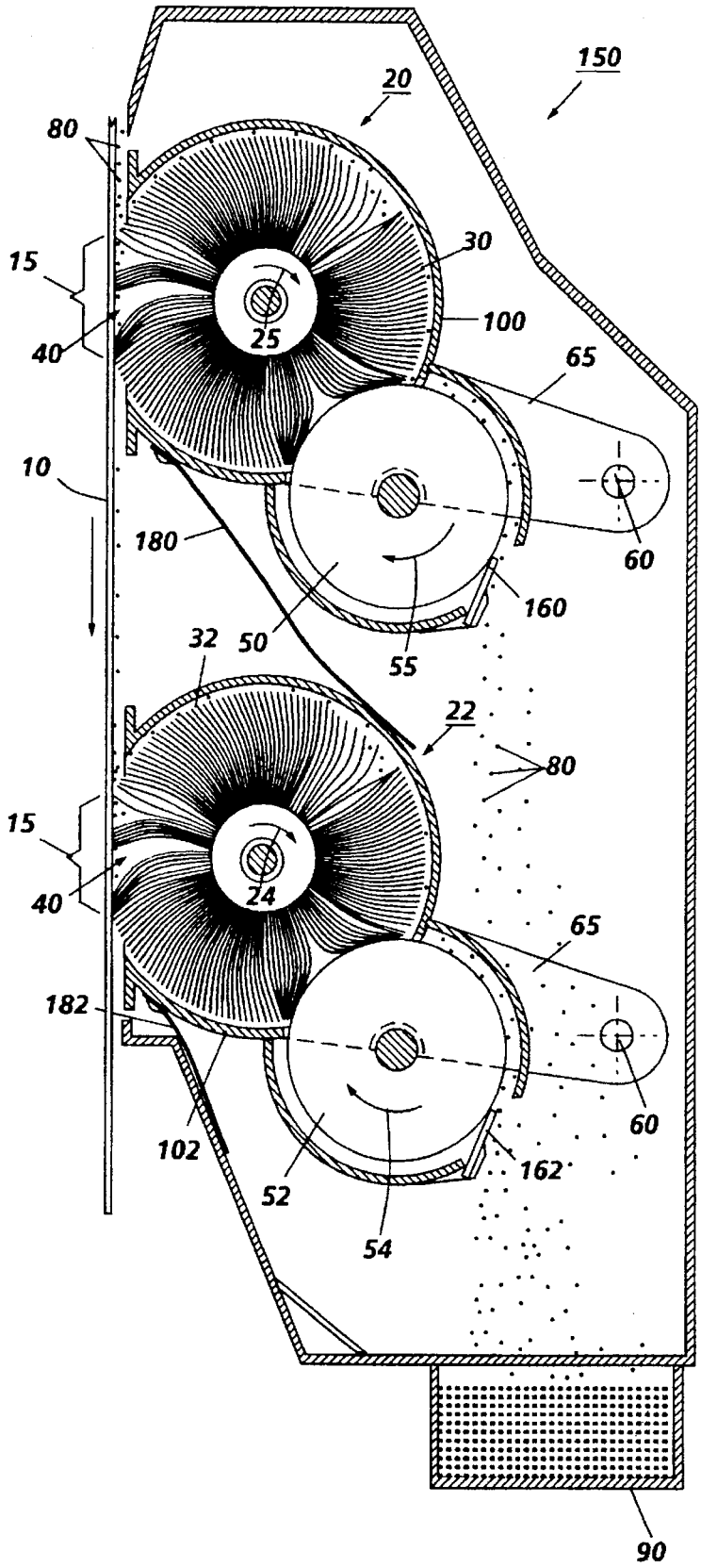
FIG. 6 is an elevational view of a dual electrostatic brush cleaner engaged with photoreceptor during normal cleaning operation.
Figure 7:
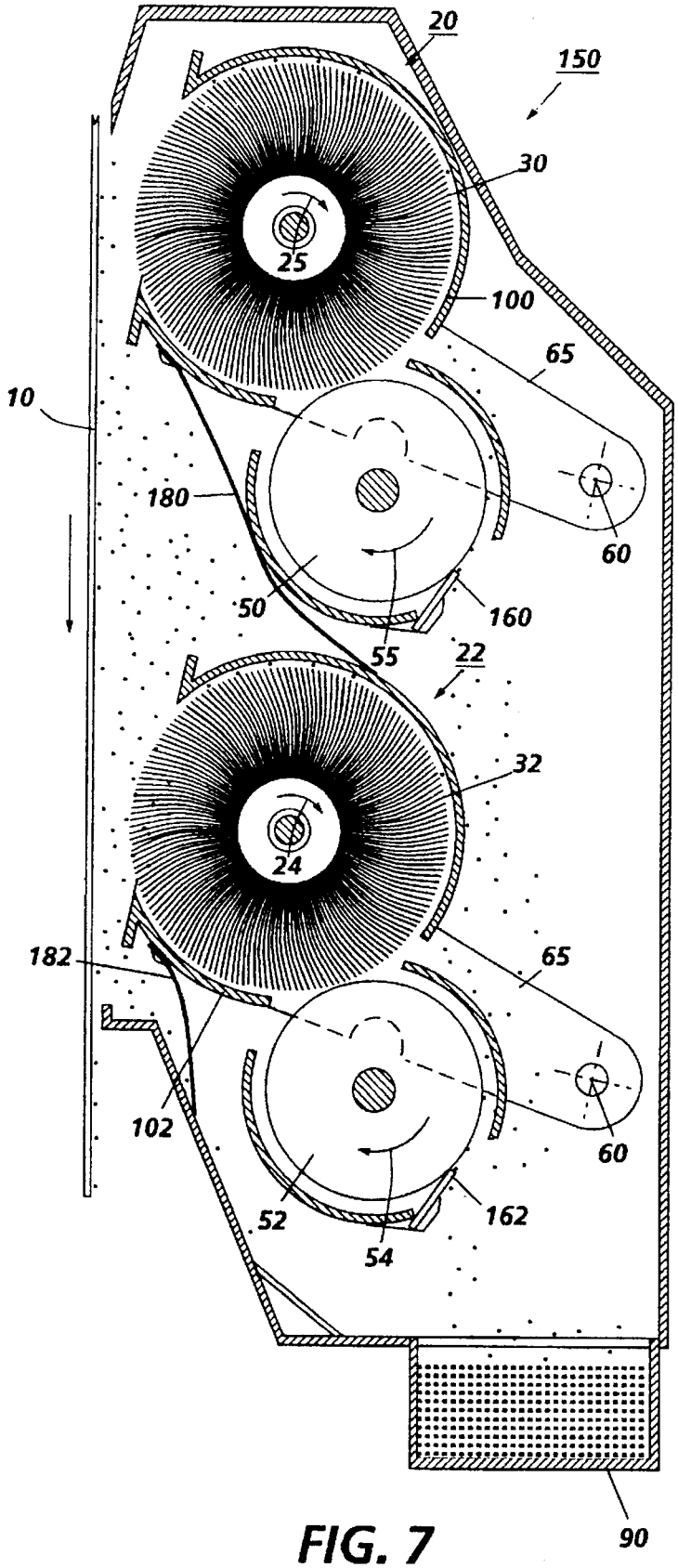
FIG. 7 is an elevational view of a dual brush cleaner retracted during a multi-pass operation in which toner emissions onto the photoreceptor occur due to the rotating brushes.
Figure 8:
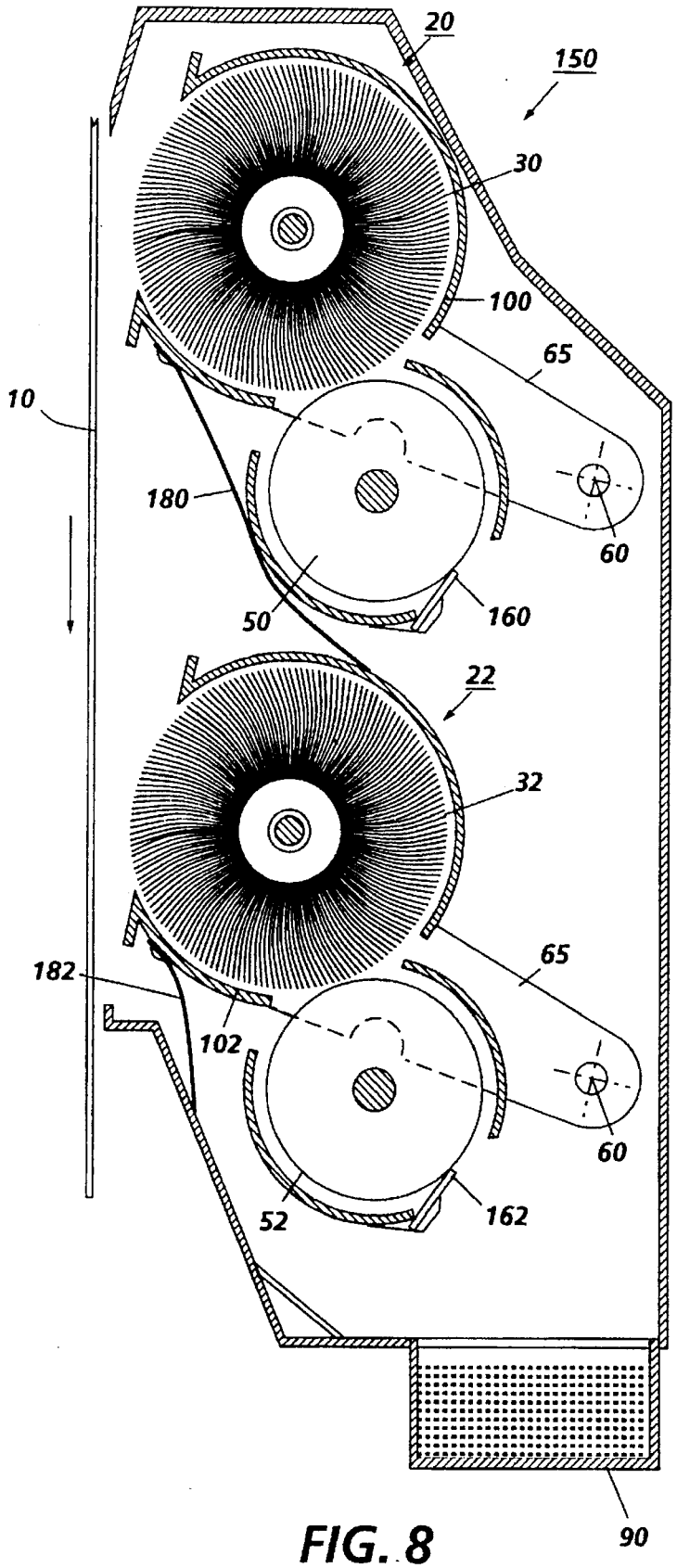
FIG. 8 is an elevational view of an embodiment of the present invention of a non-rotating retracted dual brush cleaner.

Reference is now made to FIGS. 6–8, which show the use of the present invention with dual cleaning brushes. The dual electrostatic brush cleaner comprises two brushes 20, 22 in a cleaner housing 150. Each brush 20, 22 rotates in a direction shown by arrows 25, 24, respectively, (which in this case) against that of the direction of motion of the photoreceptor 10. The fibers 30, 32 of the brush remove toner 80 from the photoreceptor 10 as the brushes, 20, 22 rotate. The toner 80 is removed from the brush fibers by electrostatic attraction of the toner to the biased roll surface that occurs when the fibers 30, 32 contact the detoning rolls 50, 52. The detoning rolls 50, 52 rotate in the same direction, shown by arrows 55, 54, respectively, as the cleaning brushes 20, 22. Scraper blades 160, 162 remove the toner particles 80 adhering to the detoning rolls 55, 54. When the cleaning apparatus is in a 3 o'clock or 9 o'clock position, the toner particles 80 gravitationally fall into a waste bottle container 190. Flexible seals 180, 182 prevent the toner particles from falling onto the photoreceptor surface.

With continuing reference to FIGS. 6–8, during a multi-pass operation such as color copying or printing, the retracted cleaning brushes 20, 22 of the present invention are held stationary, so as not to contaminate the photoreceptor 10 or machine with unwanted toner emissions caused by rotating retracted cleaning brushes.

In a multi-pass operation, the cleaning element must be retracted (not in contact with the photoreceptor 10) until after the image is transferred. If the cleaning element is not retracted, the cleaner will remove the untransferred toner layer. Upon retraction, if the cleaning brush is left rotating, the toner emissions caused by the spinning motion can collect on the photoreceptor 10, making for an unsatisfactory image (see FIG. 7). By stopping the brush 20 from rotating (i.e. spinning) immediately after being retracted from the photoreceptor 10, little or no emissions will be sent from the brush 20 onto the photoreceptor 10 or into the machine (see FIG. 8). When the cleaner is engaged (in contact with the photoreceptor 10), normal brush rotation should occur.

The brush 20 and detoning roll 50 rotations are controlled by a clutch. Engaging the clutch connects the brush 20 and detoning roll 50 shafts to the rotating drive shaft. Disengaging the clutch removes the connection and allows the brush 20 and detoning roll 50 to freely spin. Friction in the system will stop the rotation. That friction is supplied by bearing friction, brush deflection in the cleaning and detoning nips (which decreases as the brush is retracted), seals rubbing on the ends of the brush and on the detoning roll and by the detoning blade 160 scraping on the detoning roll surface.

The detoning blade 160 is the largest component of the frictional forces and acts as a brake. It is believed that all of these frictional forces will combine to stop the brush 20 and detoning roll 50 rotation in a reasonably short time so that it is not a problem. Although highly unlikely, if this is not the case, additional frictional drag will be added to the system to stop the rotations sooner.

An embodiment of the present invention in a dual (or more) brush system governed by a clutch, involves simultaneous control of the rotation of all of the brushes. In this embodiment of the present invention, the first brush 20 that engages the photoreceptor 10 surface begins to rotate. This first brush 20 determines when the second (i.e. remaining) brush 22 begins rotation. Upon retraction, the last brush to retract from the photoreceptor 10 surface stops rotating. When the last brush stops rotating the remaining brush(es) stops rotating.

FIG. 6 shows dual cleaning brushes 20, 22 engaged with the photoreceptor 10 during the cleaning operation. In this case, the cleaning brush is rotating in opposition to the photoreceptor. FIG. 7 shows the cleaning brush retracted and shows the toner emissions when the cleaning brush is left rotating during the multi-pass color operation. Toner emissions from the cleaning brush are inevitable when the cleaning brush is kept rotating due to contact with adjacent surfaces and by centrifugal forces. The fibers will "flick" toner upon recovery from contacting the cleaning brush housing, detoning roll, seals and flicker bars. FIG. 8 shows the non-rotating retracted dual cleaning brush. There is a substantial decrease in toner emissions due to the non-rotating cleaning brush.

In recapitulation, the present invention discloses retraction of non-rotating cleaner brushes along with the housings to prevent flat spots and toner emissions onto the photoreceptor or machine. The retraction of the cleaner brushes in the standby mode is such that the pivot point prevents contact of the brush fibers with either the detoning roll or the photoreceptor (i.e. contact regions).

It is, therefore, apparent that there has been provided in accordance with the present invention, a cleaner brush that prevents flat spots and toner emissions that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus having a cleaning subsystem for removing particles from a surface in a printing machine, having an operational mode and a non-operational mode, comprising:

a deformable member for removing the particles from the surface;

a second member in contact with said deformable member;

means for moving said deformable member into and out of contact with said second member to prevent the formation of a planar region on said deformable member, said moving means comprising a pivot for rotation thereabout, said pivot being positioned to minimize variations in interference and location of said second member of the cleaning subsystem against the surface; and a housing, at least partially enclosing said deformable member, said housing moving toward and away from the surface in conjunction with the movement of said deformable member so as not to contact said deformable member and further to control emissions of the particles and build up of the particles in said housing.

2. An apparatus as recited in claim 1, wherein the non-operational mode comprises said deformable member being in a standby mode.

3. An apparatus as recited in claim 1, wherein the non-operational mode comprises said printing machine being turned off.

4. An apparatus as recited in claim 1, wherein said member comprises a photoreceptor.

5. An apparatus as recited in claim 4, further comprising a second deformable member for removing particles from the surface.

6. An apparatus as recited in claim 5, wherein said deformable member is located upstream in the direction of motion of the surface from said second deformable member.

7. An apparatus as recited in claim 6, wherein said deformable member stops rotating as said moving means retracts the deformable member from the surface and said second member stops rotating as said moving means is retracted from the surface in the non-operational mode.

8. An apparatus as recited in claim 7, wherein said deformable member begins to rotate as said moving means urges the deformable member into contact with the surface and said second member begins to rotate as said moving means urges said second deformable member into contact with the surface in the operational mode.

9. An apparatus as recited in claim 8, wherein said second deformable member comprises a second cleaner brush.

10. An apparatus as recited in claim 1, wherein said second member comprises a detoning roll.

11. An apparatus as recited in claim 1, wherein said second member comprises a second housing of said deformable member, said deformable member being capable of contacting said second housing for detoning of said deformable member.

12. An apparatus as recited in claim 1, wherein said deformable member comprises a rotating cleaner brush.

13. An apparatus as recited in claim 12, wherein said rotating cleaner brush stops rotating in the non-operational mode.

14. An apparatus as recited in claim 13, wherein said rotating brush retracts away from the photoreceptor and detoning roll cleaning member.

15. A method for removing particles from a surface, with a rotatable deformable member, in an electrostatographic machine having a cleaning subsystem, in contact with a second member, comprising:

stopping operation of the cleaning subsystem;

stopping rotation of the deformable member; and retracting the rotatable deformable member about a pivot positioned to minimize space variations in the cleaning subsystem, the pivot further enabling rotation of the deformable member thereabout, out of contact with the second member to prevent contact therebetween in a common area for a substantial period of time to prevent forming a planar region on the rotatable deformable member.

16. A method as recited in claim 15, further comprising:

contacting the surface with the deformable member; and moving the deformable member and the surface, relative to one another, to prevent contact therebetween in a common area for a substantial period of time to prevent forming a planar region on the deformable member.

17. A method for removing particles as recited in claim 16, wherein said moving step comprises using a roller as the deformable member.

18. A method as recited in claim 16, wherein the moving step comprises using a cleaning brush as the deformable member.

19. A method as recited in claim 15, wherein the retracting step comprises using a photoreceptor as the second member.

20. A method as recited in claim 15, wherein the retracting step comprises using a detoning roll as the second member.

21. A method as recited in claim 15, wherein the retracting step comprises using a brush housing as the second member.

22. A method as recited in claim 15, further comprising:

stopping rotation of a second deformable member, located downstream in the direction of motion of the surface from the deformable member;

retracting the second deformable member to prevent contact therebetween in a common area for a substantial period of time to prevent forming a planar region on said second deformable member.

23. A method for removing particles from a surface, with deformable members including a first deformable member and a second deformable member located downstream, in a direction of motion from the surface, from the first deformable member, in an electrostatographic machine having a cleaning subsystem, comprising:

stopping operation of the cleaning subsystem;

retracting the first deformable member from the surface; and stopping rotation of the second deformable member and the first deformable member, simultaneously, during retracting of the second deformable member.

24. A method as recited in claim 23, wherein said retracting step comprises moving the deformable members out of contact with the surface about a pivot, preventing contact therebetween in a common area for a substantial period of time to prevent forming a planar region on the deformable members.

25. A method as recited in claim 24, further comprising:

starting operation of the cleaning subsystem;

engaging the first deformable member with the surface;

starting rotation of the first deformable member and the second deformable member; and engaging the second deformable member with the surface.

* * * * *